US012410974B2

(12) United States Patent
Palaniswamy Otte

(10) Patent No.: US 12,410,974 B2
(45) Date of Patent: Sep. 9, 2025

(54) METHOD FOR OBTAINING ONE OR MORE AIR PRODUCTS, AND AIR FRACTIONATION PLANT

(71) Applicant: Linde GmbH, Pullach (DE)

(72) Inventor: Daniel Palaniswamy Otte, Pullach (DE)

(73) Assignee: Linde GmbH, Pullach (DE)

( * ) Notice: Subject to any disclaimer, the term of this patent is extended or adjusted under 35 U.S.C. 154(b) by 311 days.

(21) Appl. No.: 18/044,038

(22) PCT Filed: Jul. 28, 2021

(86) PCT No.: PCT/EP2021/025287
§ 371 (c)(1),
(2) Date: Mar. 3, 2023

(87) PCT Pub. No.: WO2022/053172
PCT Pub. Date: Mar. 17, 2022

(65) Prior Publication Data

US 2023/0358466 A1 Nov. 9, 2023

(30) Foreign Application Priority Data

Sep. 8, 2020 (EP) ..... 20020403

(51) Int. Cl.
*F25J 3/04* (2006.01)

(52) U.S. Cl.
CPC ..... *F25J 3/04012* (2013.01); *F25J 3/04084* (2013.01); *F25J 3/04296* (2013.01);
(Continued)

(58) Field of Classification Search
CPC .. F25J 3/04012; F25J 3/04084; F25J 3/04296; F25J 3/04309; F25J 3/04381;
(Continued)

(56) References Cited

U.S. PATENT DOCUMENTS 3,905,201 A 9/1975 Coveney et al.
2015/0168057 A1* 6/2015 Musicus ..... F25J 3/04212 62/640

(Continued)

FOREIGN PATENT DOCUMENTS

CN 211926303 U 11/2020
DE 102016015446 A1 6/2018

(Continued)

OTHER PUBLICATIONS

H.-W. Häring (editor), Industrial Gases Processing, Wiley-VCH, 2006, in particular Section 2.2.5, "Cryogenic Rectification."

(Continued)

*Primary Examiner* — Miguel A Diaz
*Assistant Examiner* — Ibrahim A. Michael Adeniji
(74) *Attorney, Agent, or Firm* — Millen, White, Zelano & Branigan, P.C.; Brion P. Heaney

(57) ABSTRACT

A method for obtaining one or more air products, in which method an air fractionation plant is used which has a column system with a pressure column wherein air is fed to the column system and is fractionated in the column system, wherein at least 90% of the total amount of air supplied to the column system is compressed wherein nitrogen-rich gas is extracted from the pressure column, and wherein, at least in a first operating mode, further air is compressed to a pressure level above the base pressure level, is expanded, and is warmed without fractionation in the column system. It is provided that, at least in the first operating mode, a proportion of the nitrogen-rich gas extracted from the pressure column is fed to the further air upstream of the expansion.

15 Claims, 4 Drawing Sheets

(52) U.S. Cl.
CPC ..... *F25J 3/04309* (2013.01); *F25J 3/04381* (2013.01); *F25J 3/04393* (2013.01); *F25J 3/04678* (2013.01); *F25J 2245/42* (2013.01)

(58) Field of Classification Search
CPC .. F25J 3/04393; F25J 3/04678; F25J 2245/42; F25J 3/04812; F25J 2205/04; F25J 2215/40; F25J 2215/54; F25J 2240/46; F25J 3/0409; F25J 3/0429; F25J 3/04412; F25J 3/04727; F25J 3/04175
See application file for complete search history.

(56) References Cited

U.S. PATENT DOCUMENTS

| | | | | |
|---|---|---|---|---|
| 2017/0211882 | A1* | 7/2017 | Alekseev | F25J 3/04387 |
| 2017/0234614 | A1* | 8/2017 | Lautenschlager | F25J 3/04054 62/645 |
| 2018/0017322 | A1* | 1/2018 | Golubev | F25J 3/04412 |
| 2018/0180357 | A1* | 6/2018 | Golubev | F25J 3/04393 |

FOREIGN PATENT DOCUMENTS

| | | | | |
|---|---|---|---|---|
| EP | 2963367 | A1 | 1/2016 | |
| EP | 2980514 | A1 | 2/2016 | |
| EP | 3343158 | A1 | 7/2018 | |
| GB | 727911 | A | 4/1955 | |
| WO | WO-2014154339 | A2 * | 10/2014 | F25J 3/04054 |

OTHER PUBLICATIONS

F.G. Kerry, Industrial Gas Handbook: Gas Separation and Purification, CRC Press, 2006, in particular sections 2.4, "Contemporary Liquefaction Cycles," 2.6, "Theoretical Analysis of the Claude Cycle," and 3.8.1. "The Lachmann Principle."

* cited by examiner

METHOD FOR OBTAINING ONE OR MORE AIR PRODUCTS, AND AIR FRACTIONATION PLANT

The present invention relates to a method for obtaining one or more air products, and to an air fractionation plant, according to the preambles of the independent claims.

BACKGROUND OF THE INVENTION

The production of air products in the liquid or gaseous state by cryogenic fractionation of air in air fractionation plants is known and described, for example, in H.-W. Häring (editor), Industrial Gases Processing, Wiley-VCH, 2006, in particular Section 2.2.5, "Cryogenic Rectification."

Air fractionation plants of the classic type have column systems that can be designed as two-column systems, in particular as double-column systems, but also as triple-column or multi-column systems. In addition to rectification columns for obtaining nitrogen and/or oxygen in the liquid and/or gaseous state, i.e., rectification columns for nitrogen-oxygen separation, rectification columns for obtaining further air components, in particular of noble gases, can be provided.

The rectification columns of the mentioned column systems are operated at different pressure levels. Known double-column systems have a so-called pressure column (also referred to as a high-pressure column, medium-pressure column or lower column) and a so-called low-pressure column (also referred to as an upper column). The high-pressure column is typically operated at a pressure level of 4 to 7 bar, in particular about 5.6 bar, the low-pressure column on the other hand is operated at a pressure of typically 1 to 2 bar, in particular about 1.4 bar. In certain cases, even higher pressure levels may be used in either rectification column. The pressures cited here and below are absolute pressures at the top of the respective columns indicated.

The object of the present invention is to improve methods for the low-temperature fractionation of air and for the provision of air products—and, in particular, to design them more efficiently.

DISCLOSURE OF THE INVENTION

This object is achieved by a method for obtaining one or more air products, and by an air fractionation plant having the features of the independent claims. Embodiments are respectively the subject matter of the dependent claims and of the description below.

In the following, a few principles of the present invention are first explained and terms used to describe the invention are defined.

Methods utilizing a main (air) compressor and a booster air compressor (MAC/BAC), and also so-called high air pressure (HAP) methods, may be used for air fractionation. The methods using a main air compressor and a booster air compressor are the more conventional methods; high air pressure methods are increasingly used as alternatives nowadays.

Main air compressor/booster air compressor methods are characterized in that only a portion of the total feed air quantity that is supplied to the column system is compressed to a pressure level which is substantially—i.e., at least 3, 4, 5, 6, 7, 8, 9, or 10 bar-above the pressure level of the pressure column, and is thus the highest pressure level used in the column system. A further portion of the feed air quantity is compressed only to the pressure level of the pressure column or to a pressure level which differs by no more than 1 to 2 bar therefrom, and is fed into the pressure column at this lower pressure level without decompression. An example of a main air compressor/booster air compressor method is disclosed in Häring (see above) in FIG. 2.3A.

In a high air pressure method, on the other hand, the entire feed air quantity that is supplied in total to the column system is compressed to a pressure level which is substantially, i.e., by 3, 4, 5, 6, 7, 8, 9, or 10 bar, above the pressure level of the pressure column, and is therefore the highest pressure level used in the column system. The pressure difference can be up to 14, 16, 18, or 20 bar, for example. High air pressure methods have been described in detail, for example, from EP 2 980 514 A1 and EP 2 963 367 A1.

Regarding the devices or apparatuses used in air separation units, reference is made to specialist literature, such as Häring (see above), in particular section 2.2.5.6, "Apparatus." Hereinafter, some aspects of corresponding devices are explained in more detail for clarity and a clearer delimitation.

Multi-stage turbocompressors, which are referred to here as "main air compressors," or "main compressors" for short, are used in air fractionation plants to compress the total fractionated air. The mechanical construction of turbocompressors is generally known to the person skilled in the art. In a turbocompressor, the compression of the medium to be compressed takes place by means of turbine blades and/or impellers which are arranged on a turbine wheel or directly on a shaft. A turbocompressor forms a structural unit that, however, may have a plurality of compressor stages in a multi-stage turbocompressor. A compressor stage normally comprises a turbine wheel or a corresponding arrangement of turbine blades. All of these compressor stages may be driven by a common shaft. However, it may also be provided that the compressor stages are driven in groups with different shafts, wherein the shafts may also be connected to one another via gearing.

The main air compressor is further characterized in that the entire quantity of fractionated air which is supplied to the column system and used for the production of air products, i.e., the entirety of air in the system, is compressed by said main air compressor. Accordingly, a "booster air compressor" may also be provided in which, however, only a portion of the air quantity compressed in the main air compressor is brought to an even higher pressure. This may also be designed a turbocompressor. In order to compress partial air quantities, further turbocompressors are typically provided, also referred to as boosters, that only perform compression to a relatively small extent in comparison to the main air compressor or the booster air compressor. A booster air compressor may also be present in a high air pressure method, but this compressor then compresses a sub-quantity of the air starting from a correspondingly higher pressure level.

Air can also be decompressed at a plurality of locations in air separation units, for which purpose decompression machines in the form of turboexpanders, also referred to herein as "decompression turbines," may also be used, among other things. Turboexpanders may also be coupled to and drive turbocompressors. If one or more turbocompressors are driven without externally supplied energy, i.e., only via one or more turboexpanders, the term "turbine booster" or "booster turbine" is also used for such an arrangement. In a turbine booster, the turboexpander (the decompression turbine) and the turbocompressor (the booster) are mechanically coupled, wherein the coupling may take place at the same rotational speed (for example via a common shaft) or at different rotational speeds (for example via an interposed transmission).

In typical air separation units, corresponding decompression turbines are present at different points for refrigeration and liquefaction of mass flows. These are in particular what are known as Joule-Thomson turbines, Claude turbines, and Lachmann turbines. In addition to the following explanations, reference is made regarding the function and purpose of corresponding turbines to the technical literature, for example F. G. Kerry, Industrial Gas Handbook: Gas Separation and Purification, CRC Press, 2006, in particular sections 2.4, "Contemporary Liquefaction Cycles," 2.6, "Theoretical Analysis of the Claude Cycle," and 3.8.1. "The Lachmann Principle."

In the language as used herein, liquid fluids, gaseous fluids, or also fluids present in a supercritical state may be rich or poor in one or more components, wherein "rich" may refer to a content of at least 75%, 90%, 95%, 99%, 99.5%, 99.9%, or 99.99%, and "poor" may refer to a content of at most 25%, 10%, 5%, 1%, 0.1%, or 0.01% on a molar, weight, or volume basis. The term "predominantly" may correspond to the definition of "rich" as was just given, but in particular denotes a content of more than 90%. For example, if "nitrogen" is discussed here, this may refer to a pure gas but also to a gas rich in nitrogen.

In the following, the terms "pressure level" and "temperature level" are used to characterize pressures and temperatures, whereby it should be expressed that pressures and temperatures do not need to be used in the form of exact pressure or temperature values in order to realize an inventive concept. However, such pressures and temperatures typically fall within certain ranges that are, for example, +1%, 5%, or 10% around an average. Different pressure levels and temperature levels may be in disjoint ranges or in ranges which overlap one another. In particular, pressure levels, for example, include unavoidable or expected pressure losses, for example due to cooling effects. The same applies to temperature levels. The pressure levels indicated here in bar are absolute pressures unless otherwise stated.

Features and Advantages of the Invention

While an HAP method is typically more cost-effective than conventional MAC/BAC methods due to the low number of rotating machines and the higher pressures used, there are usually disadvantages as regards the energy used—typically with regard to the creation costs and some operating costs.

In plants with a very high liquid capacity (i.e., a comparatively large amount of air products removed from the plant in liquid form), compared to internally compressed flows (for internal compression, reference is likewise made to the technical literature cited in the introduction), or in the case of (substantially) exclusively liquid production, so-called "excess air" methods are used (see also FIG. 1 and the explanations in this regard).

The present invention is based on the knowledge that a modification of a corresponding "excess air" method offers particular advantages. In a method of this kind, generally speaking, a portion of the total compressed and cooled air is decompressed by turbine, but is not fed to the pressure column (as in a Joule-Thomson turbine) or to the low-pressure column (as in a Lachmann turbine) and fractionated there, but rather is again warmed to a warm-side temperature in the main heat exchanger, without fractionation, and is discharged from the unit. The decompression can take place in particular to atmospheric pressure. Since the air of a correspondingly warmed material stream has already been subjected to a purification, it can in principle again be fed to the process air which will be compressed—that is, upstream of the main heat exchanger-instead of being discharged to the atmosphere. Corresponding methods, also in combination with the HAP methods already explained, are known from U.S. Pat. No. 3,905,201 A, WO 2014 154 339 A2 and EP 3 343 158 A1.

In one example, which can also be used in connection with the present invention, air in the main air compressor can be compressed to a high pressure, for example 23 bar (HAP). Subsequently, the air can be further compressed in one or two boosters that are connected, usually in series. The boosters are driven by turbines. In this case, a turbine decompresses the air down from the pressure achieved by means of the booster, which is above the HAP pressure, to the pressure column pressure (e.g., 5.6 bar). This air is then divided into the necessary pressure column air (which is necessary for rectification) and an excess fraction. The excess fraction (the "excess air"; hereinafter referred to as excess air) is warmed in the main heat exchanger and fed to a second turbine, which drives the second booster or (depending on the liquid capacity in relation to the internal compression quantity) a generator, and decompresses it to a pressure which is somewhat above ambient pressure. This fraction is then warmed in the main heat exchanger and, for example, blown out into the surroundings.

The present invention makes it possible, by means of the measures explained below, to improve the performance (in the sense of the total cost of ownership, TCO) of HAP methods, especially in the case under consideration of a high liquid production in which the use of an excess air turbine is expedient. The present invention can be used in particular in cases in which more than 35%, in particular more than 40% or more than 50% liquid air products, based on the amount of internal air products, are at least at times taken from the air fractionation plant.

The present invention makes use of the fact that the so-called injection equivalent is not fully utilized in many installations and operating cases. It is known that an increase in the injection equivalent can improve energy consumption.

The term "injection equivalent" refers to compressed air decompressed with a typical Lachmann turbine ("injection turbine") and fed into ("injected into") the low-pressure column. The air thus expanded into the low-pressure column interferes with rectification, which is why the quantity of air which can be expanded in the injection turbine and thus the cold that can be generated in this way for a corresponding unit are limited. Nitrogen-rich air products which are removed from the pressure column and discharged from the air fractionation plant also influence the rectification process in this way. The quantity of air injected into the low-pressure column plus the nitrogen removed from the pressure column and discharged from the air fractionation plant can be specified in relation to the total air supplied to the column system. The value obtained is the "injection equivalent."

The injection equivalent is thus defined as the quantity of compressed air which is decompressed by means of an injection turbine into the low-pressure column of an air fractionation plant, plus the quantity of nitrogen that may have been taken from the pressure column and neither returned to the pressure column itself as a liquid return nor fed to the low-pressure column as a liquid return, in relation to the total compressed air fed into the column system. The nitrogen taken from the pressure column can be pure or substantially pure nitrogen from the head of the pressure column, or can be a nitrogen-enriched gas which can be withdrawn, with a lower nitrogen content, from the pressure column from a region below the head.

As mentioned, the increase in the injection equivalent improves the energy consumption. In the context of the present invention, in which an HAP method is used with an excess air turbine, the increase is achieved in the excess air turbine by decompression of at least a portion of the compressed nitrogen from the pressure column, or more generally of a nitrogen-rich fluid from the pressure column.

By increasing the injection equivalent, the amount of air required for providing the desired products is increased exponentially. Furthermore, an increase in the injection equivalent reduces the argon yield. To optimize this, there is an optimum up to which the injection equivalent can be exploited. This optimum is around 10 to 20 depending on energy and the utility of argon. In plants without argon production, the optimum is significantly higher.

Overall, the present invention proposes a method for obtaining one or more air products, wherein an air fractionation plant is used which has a column system with a pressure column, wherein the pressure column is operated in a pressure range from 4 to 7 bar, for example 5 to 6 bar, in particular about 5.6 bar, wherein air is fed to the column system and fractionated in the column system, and wherein at least 90% of the total air supplied to the column system, in particular more than 95%, or all of the air, is compressed to a base pressure level which is more than 5 bar above the pressure range at which the pressure column is operated, for example at 20 to 30 bar, in particular about 23 bar. Thus, as mentioned several times, an HAP method is used. Nitrogen-rich gas is withdrawn from the pressure column and, at least in a first operating mode, further air is compressed to a pressure level above the base pressure level, is decompressed, and is warmed without fractionation in the column system. In the context of the present invention, at least in the first operating mode, a portion of the nitrogen-rich gas of the further air withdrawn from the pressure column is fed back in upstream of the decompression. The feed can take place before the warming of the further air, in which case the warming of the further air and of the added nitrogen-rich gas takes place at the same time, in particular in the main heat exchanger. However, the feed can also take place after the warming of the further air, wherein the further air and the added nitrogen-rich gas are then warmed beforehand separately from one another, in particular in the main heat exchanger. Both alternatives are explained in more detail below as embodiments of the invention.

By feeding the nitrogen-rich gas withdrawn from the pressure column back to the excess air, the injection equivalent can be better exploited. The required excess air is reduced by this feed (in an amount which is selected according to the products constellation and, accordingly, the optimal injection equivalent). The power of the turbine used for the decompression of the excess air remains approximately the same, since the additional amount of nitrogen-rich gas withdrawn from the pressure column compensates for the reduction of the excess air.

Since the injection equivalent is increased in the context of the present invention, the amount of air to the rectification increases. Overall, however, the amount of air required at the main air compressor is reduced. The reduction can be up to about 6%, depending on the products constellation. The reduction is directly reflected in energy savings. However, the increase in the injection equivalent also reduces the argon yield; but the total costs are reduced.

The present invention can be carried out in different operating modes, wherein the aforementioned "first" operating mode can also be the only operating mode. In one method variant, on the other hand, a second operating mode can be provided, wherein in the second operating mode as well, the further air is compressed to a pressure level above the base pressure level, decompressed, and warmed without fractionation in the column system (i.e., excess air is used), and wherein no nitrogen-rich gas withdrawn from the pressure column is fed to the further air in the second operating mode. In this embodiment, the injection equivalent can be temporarily lowered, for example, in the second operating mode if an increased argon production is desired.

Finally, a third operating mode can also be provided. (The numbering is only provided for clarity here; no second operating mode need be present; the method can also comprise only the first and third operating modes, for example.) In the third operating mode, no further air is compressed to a pressure level above the base pressure level, decompressed, and warmed without fractionation in the column system (i.e. no excess air is used); and in the third operating mode, a portion of the nitrogen-rich gas withdrawn from the pressure column is decompressed and warmed instead of the further air. In this way, for example, in cases where a reduced amount of nitrogen products should be produced, the plant should be driven to high energy optimization, and/or argon production is unimportant, in the third operating mode the injection equivalent can correspondingly be increased. Argon production is thus minimized when the injection equivalent is maximized.

In one embodiment of the present invention, for use as excess air, the further air can be supplied at the pressure level above the base pressure level to a main heat exchanger of the air fractionation plant at the warm side, then can be removed from the main heat exchanger at a first intermediate temperature level, then subjected to a first turbine decompression, then supplied to the main heat exchanger at the cold side, then withdrawn from the main heat exchanger at a second intermediate temperature level, then subjected to a second turbine decompression, then supplied to the main heat exchanger at a third intermediate temperature level, and then removed from the main heat exchanger at the warm side. As such, two turbine decompression steps take place, between which warming takes place in the main heat exchanger, so that the decompression cooling generated during the decompression can be used in the main heat exchanger.

The portion of the nitrogen-rich gas withdrawn from the pressure column, which is fed to the further air—that is to say, the excess air—can in particular be supplied to the main heat exchanger at the cold side together with the further air after its first turbine decompression, can be subjected to the second turbine decompression, supplied to the main heat exchanger at the third intermediate temperature level, and removed from the main heat exchanger at the warm side. In other words, the nitrogen-rich gas is therefore warmed together with the further air. In a further embodiment, the portion of the nitrogen-rich gas withdrawn from the pressure column which is fed to the further air, that is to say the excess air, can also be fed to the main heat exchanger at the cold side, can be removed at the warm side and fed to the further air at the second intermediate temperature level and before the second turbine decompression. In this embodiment, a separate warming therefore takes place.

In the context of the present invention, as mentioned, the base pressure level (HAP pressure) can be 11 to 28 bar, in particular 16 to 24 bar, for example about 23 bar. The pressure level above the base pressure level to which the further air, i.e., the air used to provide the excess air, is compressed, can in each case be increased in each subsequent booster in particular by 1.1 to 1.6-fold, in particular to 22 to 50 bar, for example 22 to 30 bar in plants in which the second turbine decompression of the excess air is carried out in a turbine which is coupled to a generator, and 35 to 50 bar in plants in which the second turbine decompression of the excess air is carried out in a turbine which is coupled to a booster. The pressure range in which the pressure column is operated can in particular be 4 to 7 bar, for example 5 to 6 bar, in particular about 5.6 bar, as mentioned. The main heat exchanger can be operated at a temperature level of from 0 to 50° C. on the warm side, and at a temperature level of from −150 to −177° C. on the cold side. The mentioned first intermediate temperature level may be −120 to −90° C., the second intermediate temperature level may be −20 to 30° C., the third intermediate temperature level may be −110 to −60° C. The first turbine decompression can be carried out to a pressure level of 4 to 7 bar, and the second turbine decompression can be carried out to a pressure level of 100 mbar to 500 mbar above atmospheric pressure.

In the context of the present invention, the further air, that is to say the air used to provide the excess air, can be compressed using one or two boosters to the pressure level above the base pressure level, wherein the one booster or at least one of the two boosters is or are driven using at least one of the decompression machines which are used in the mentioned first and second turbine decompression. In other words, in the case where one booster is used, the booster can be driven using the decompression machine used in the first or second turbine decompression, or, when two boosters are used, one can be driven by the decompression machine used in the first turbine decompression and the other can be driven using the decompression machine used in the second turbine decompression. The specific assignment is arbitrary. As mentioned, one of the decompression machines can also be braked, for example, by means of a generator, or in some other way, in which case the further air is typically compressed using only one booster to the pressure level above the base pressure level.

In any case, the column system used in the context of the present invention can have a low-pressure column operated within a pressure range from 1 to 1.7 bar, and also an argon recovery section with at least one further column. As mentioned, the increase in the injection equivalent can impair the production of argon. In particular, the use of a plurality of operating modes enables a flexible adaptation to needs.

The further air which is compressed to the pressure level above the base pressure level, decompressed and warmed without fractionation in the column system, that is to say the air used as excess air, can be compressed together with air which is fed into the column system to the pressure level above the base pressure level. This air which is fed into the column system and which is compressed together with the further air to the pressure level above the base pressure level can in particular be cooled in a first fraction and fed into the column system without being subjected to the first and second decompression, and in a second fraction can be separated in liquefied form after the first decompression and fed into the column system.

The present invention also extends to an air separation unit. For features and advantages of such an air separation unit, reference is made to the corresponding independent claim. In particular, such an air separation unit is designed to carry out a method in one or more of the previously explained embodiments and has correspondingly designed means for this purpose. For features and advantages, reference is therefore expressly made to the above explanations.

The invention will be described in more detail below with reference to the accompanying drawings, which illustrate preferred embodiments of the present invention.

In the figures, identical or comparable elements are in each case designated by identical reference signs and are not explained repeatedly for the sake of clarity. Components which are illustrated identically in multiple figures are sometimes not provided again with reference signs. Plant components can in each case also represent corresponding method steps, such that the following explanations regarding the air fractionation plants also relate to corresponding methods.

DETAILED DESCRIPTION OF THE DRAWINGS

Figure 1:
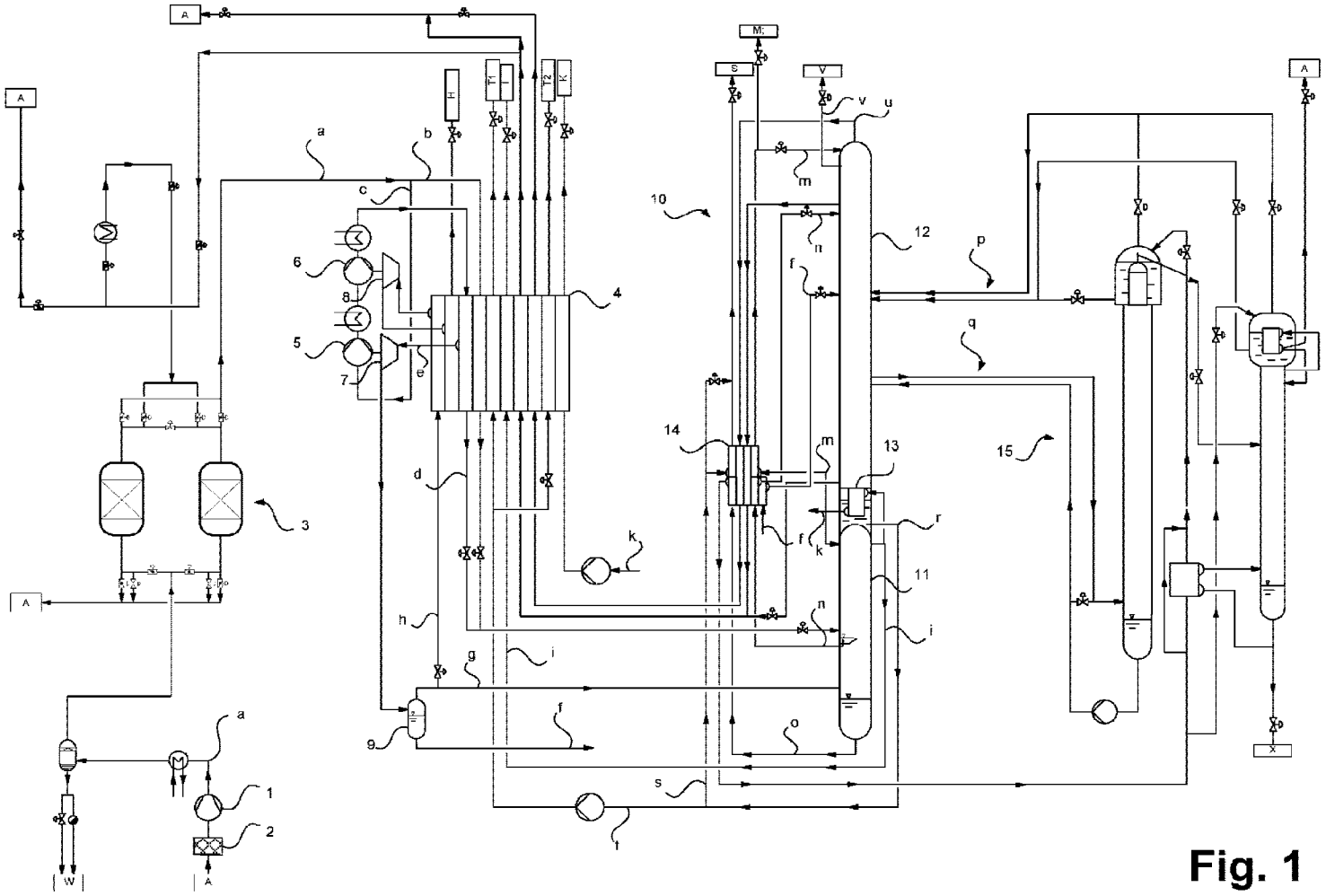
FIG. 1 shows a simplified illustration of an air fractionation plant which is not designed according to the invention.

FIG. 1 illustrates an air fractionation plant, not designed according to the invention, in the form of a simplified process flow diagram.

In the air fractionation plant according to FIG. 1, air from the atmosphere A is suctioned in by means of a main air compressor 1 via a filter 2 and compressed to the above-mentioned base pressure level. A compressed air stream a provided in this way is fed after cooling in heat exchangers (not designated separately) and a separation of water W to an adsorber station 3, and freed there of undesired components such as water and carbon dioxide. The compressed air flow a is divided into two partial streams b and c.

The partial stream b is fed to a main heat exchanger 4 at the hot end and removed at the cold end. The partial stream c is further compressed using two boosters 5 and 6 and then likewise fed to the main heat exchanger 4 at the hot end. A partial stream d of the partial stream c is again taken from the main heat exchanger 4 at the cold end. The partial streams b and d are decompressed via a throttle, are at least to some extent liquefied in the process, are combined, and are fed into a pressure column 11 of a column system 10 in the form of a material stream which is not designated separately.

In addition to the pressure column 11, the column system 10 has a low-pressure column 12 connected to the pressure column 11 in the form of a double column, and thermally coupled via a main condenser 13. As a further part of the column system 10, a supercooling countercurrent unit 14 and a conventional argon recovery part 15 are provided, by means of which pure argon X can be obtained. The latter can be operated as described in numerous examples in the technical literature. In both the pressure column 11 and the low-pressure column 12, a low-temperature rectification is carried out at a rectification pressure level.

A further partial stream e of the partial stream c is taken from the main heat exchanger 4 at an intermediate temperature level, decompressed in a decompression turbine 7 coupled to the booster 5, thereby partially liquefied, and fed into a separator 9, where a liquid phase and a gas phase form. The liquid phase is conveyed in the form of a material stream f through the supercooling countercurrent unit 14, and then fed into the low-pressure column 12. The gas phase is divided into two partial streams g and h.

The partial stream g is fed into the pressure column 11. The partial stream h, on the other hand, is fed to the main heat exchanger 4 at the cold end and removed from the latter close to the hot end. It is subsequently decompressed in a decompression turbine 8 coupled to the booster 6, fed back to the main heat exchanger 4 at an intermediate temperature level, removed from the main heat exchanger at the hot end, and discharged from the plant. This is the so-called excess air-here also denoted by H. Since the partial stream h already comprises purified air, it can be compressed again, for example, in the main air compressor 2 and used to form the compressed air flow a in order to reduce the purification effort.

At the top of the pressure column 11, a nitrogen-rich top gas is formed, one part of which is warmed in gaseous form in the form of a material stream i in the main heat exchanger 4 and discharged as a compressed product I from the air fractionation plant. A further part is at least partially condensed in the main condenser 13. A first part (not designated) of the condensate is recycled as a return flow to the pressure column 11; a second part is provided in the form of a stream k, as an internally compressed nitrogen product K; and a third part is conveyed in the form of a material stream m through the supercooling countercurrent unit 14 and is fed at the top thereof to the low-pressure column 12 as a return flow.

The low-pressure column 12 is primarily fed with the bottoms liquid of the pressure column 11, which is withdrawn therefrom in the form of a material stream o. In the example shown, the bottoms liquid of the pressure column 11 is used for cooling top condensers in the argon recovery section 15, and is partially evaporated there. Evaporated and unevaporated fractions are transferred, as illustrated here in the form of material streams p, into the low-pressure column 12. The argon recovery section 15 is materially connected to the low-pressure column 12 by material streams q, not explained in more detail here. Furthermore, liquid air in the form of a material stream n is fed into the low-pressure column 12, and withdrawn directly below the feed point for the material streams b and d from the pressure column 11 and conveyed through the supercooling countercurrent unit 14.

Bottoms liquid from the low-pressure column 12 can be withdrawn therefrom in the form of a material stream r and provided in part in the form of a material stream S as liquid nitrogen S, and can be further used in part in the form of a material stream t to provide internal compression products T1, T1. Gaseous nitrogen can be drawn off from the top of the low-pressure column 12 in the form of a material stream u, and liquid nitrogen can be drawn off in the form of a material stream v. The latter can be provided as liquid nitrogen V, and a partial stream of the material stream M can be provided as pressurized liquid nitrogen M.

Figure 2:
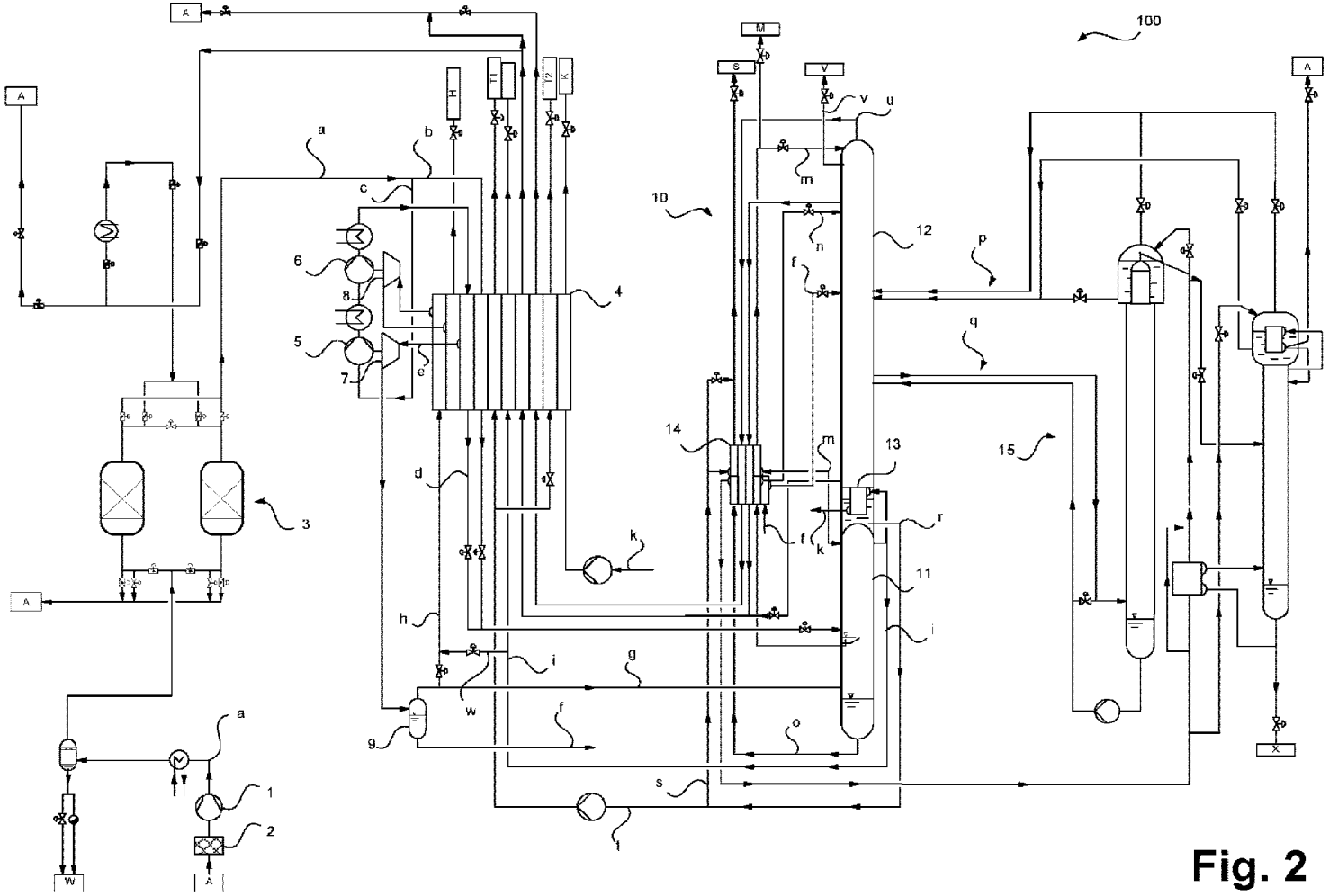
FIG. 2 shows an air fractionation plant according to an embodiment of the invention in a simplified schematic representation.

FIG. 2 shows an air fractionation plant according to an embodiment of the invention in a simplified schematic representation. This is denoted as a whole by 100 and comprises all components of the air fractionation plant illustrated in FIG. 1.

In the air fractionation plant, as illustrated here in the form of a material stream w, a partial stream of the material stream i can be fed into the material stream h, at least in one operating mode, and can be warmed and decompressed with it in the manner described. In other operating modes, the formation of the material stream w can also be prevented, or the material stream w can completely replace the material stream h.

Figure 3:
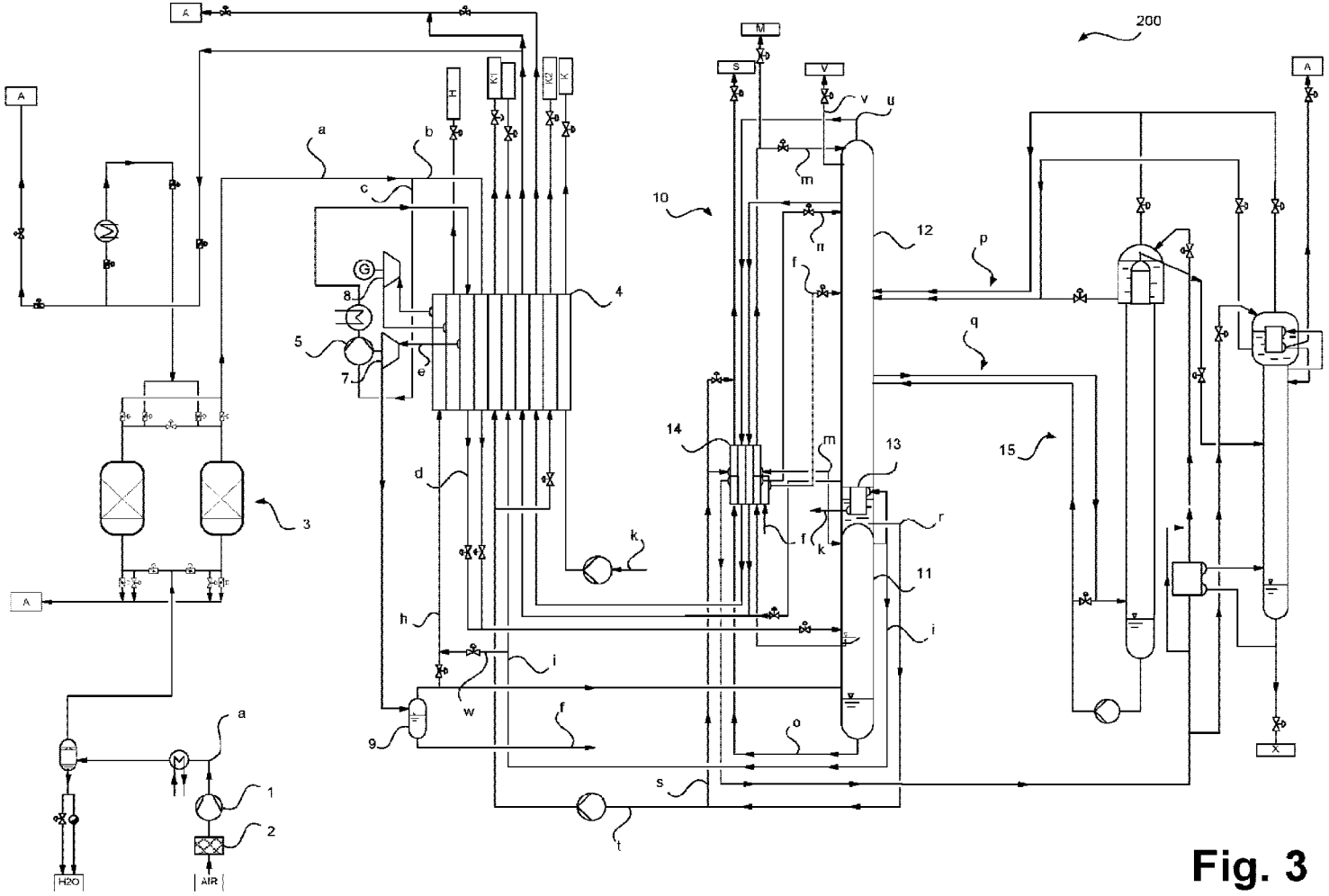
FIG. 3 shows an air fractionation plant according to an embodiment of the invention in a simplified schematic representation.

FIG. 3 shows an air fractionation plant according to a further embodiment of the invention in a simplified representation. It is denoted as a whole by 200, and comprises all components of the air fractionation plant 100 illustrated in FIG. 2; however, a generator G is provided instead of the booster 6. The partial stream c is thus only compressed by means of the booster 5.

Figure 4:
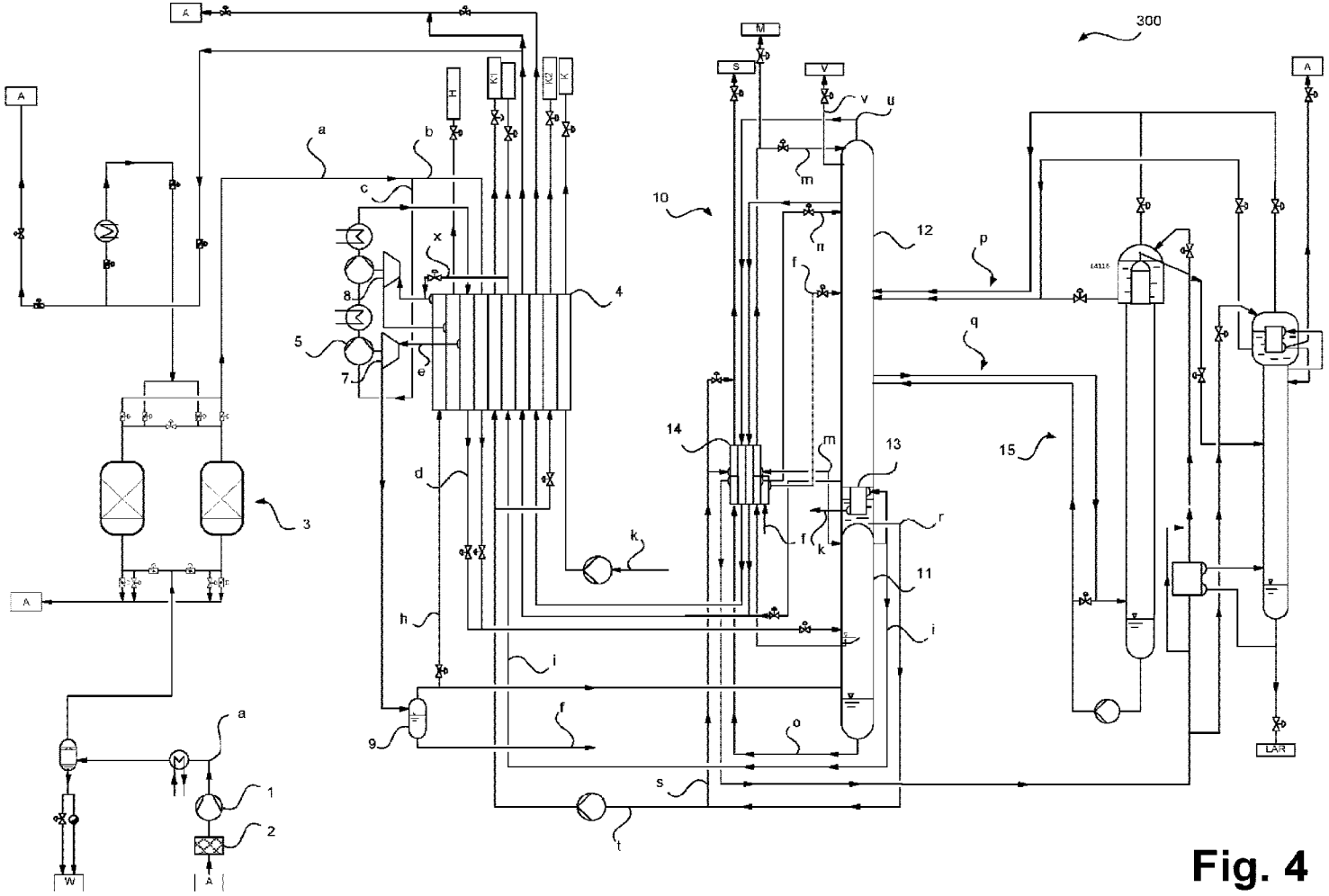
FIG. 4 shows an air fractionation plant according to an embodiment of the invention in a simplified schematic representation.

FIG. 4 shows an air fractionation plant according to a further embodiment of the invention, in a simplified representation. It is denoted as a whole by 300 and comprises all components of the air fractionation plant 100 illustrated in FIG. 2; however, in contrast thereto, instead of the material stream w there at the warm side of the main heat exchanger 4, a material stream x is branched off from the material stream i and is fed to the material stream h.

The invention claimed is:

1. A method for obtaining one or more air products, wherein an air fractionation plant is used which has a column system having a pressure column, wherein the pressure column is operated in a pressure range from 4 to 7 bar, wherein air is fed to the column system and fractionated in the column system, wherein at least 90% of the total air supplied to the column system is compressed to a base pressure level which is more than 5 bar above the pressure range at which the pressure column is operated, wherein nitrogen-rich gas is withdrawn from the pressure column, and wherein, at least in a first operating mode, further air is compressed to a pressure level above the base pressure level, is decompressed, and is warmed without fractionation in the column system, wherein, at least in the first operating mode, a portion of the nitrogen-rich gas withdrawn from the pressure column is fed into the further air upstream of the decompression.

2. The method according to claim 1, wherein the decompression of the further air is carried out in a decompression machine.

3. The method according to claim 1, wherein, in a second operating mode as well, the further air is compressed to a pressure level above the base pressure level, is decompressed, and is warmed without fractionation in the column system, and wherein, in the second operating mode, none of the nitrogen-rich gas withdrawn from the pressure column is fed into the further air.

4. The method according to claim 3, wherein, in the third operating mode, no further air is compressed to a pressure level above the base pressure level, decompressed and warmed without fractionation in the column system, and in which, in the third operating mode, a portion of the nitrogen-rich gas withdrawn from the pressure column is decompressed and warmed instead of the further air.

5. The method according to claim 1, wherein the further air, at the pressure level above the base pressure level, is supplied to the warm side of a main heat exchanger of the air fractionation plant, is then removed from the main heat exchanger at a first intermediate temperature level, is then subjected to a first turbine decompression, is then supplied to the cold side of the main heat exchanger, is then removed from the main heat exchanger at a second intermediate temperature level, is then subjected to a second turbine decompression, is then supplied to the main heat exchanger at a third intermediate temperature level, and is then withdrawn from the warm side of the main heat exchanger.

6. The method according to claim 5, wherein the portion of the nitrogen-rich gas withdrawn from the pressure column which is fed into the further air is fed to the cold side of the main heat exchanger together with the further air, is subjected to the second turbine decompression, is fed to the main heat exchanger at the third intermediate temperature level, and is withdrawn from the warm side of the main heat exchanger.

7. The method according to claim 5, wherein the portion of the nitrogen-rich gas withdrawn from the pressure column which is fed to the further air is supplied to the cold side of the main heat exchanger separately from the further air, is withdrawn from the warm side of the main heat exchanger, and is fed to the further air at the second intermediate temperature level and before the second turbine decompression.

8. The method according to claim 5, wherein the base pressure level is 16 to 24 bar, wherein the pressure level above the base pressure level to which the further air is compressed is 27 to 50 bar, wherein the pressure range in which the pressure column is operated is 4 to 7 bar, wherein the main heat exchanger is operated at a temperature level of 0 to 50° C. on the warm side, and at a temperature level of to −177° C. on the cold side, wherein the first intermediate temperature level is to −90° C., wherein the second intermediate temperature level is to 30° C., wherein the third intermediate temperature level is to −60° C., wherein the first turbine decompression is carried out to a pressure level of 4 to 7 bar, and wherein the second turbine decompression is carried out to a pressure level of 100 to 500 mbar above atmospheric pressure.

9. The method according to claim 5, wherein the further air is compressed using one or two boosters to the pressure level above the base pressure level, wherein the one booster or at least one of the two boosters is or are driven using at least one of the decompression machines which are used in the first and second turbine decompression.

10. The method according to claim 1, wherein the column system further comprises a low-pressure column operated in a pressure range from 1 to 1.7 bar, and an argon gas recovery section having at least one further column.

11. The method according to claim 1, wherein the further air which is compressed to the pressure level above the base pressure level, is decompressed, and is warmed without fractionation in the column system, is compressed to the pressure level above the base pressure level together with air which is fed into the column system.

12. The method according to claim 11, wherein the air which is fed into the column system and which is compressed together with the further air to the pressure level above the base pressure level is cooled in a first fraction and fed into the column system without being subjected to the first and second decompression, and in a second fraction is separated in liquefied form after the first decompression and fed into the column system.

13. An air fractionation plant comprising a column system having a pressure column, wherein the air fractionation plant is designed to operate the pressure column in a pressure range from 4 to 7 bar, to supply air to the column system, and to fractionate it in the column system, and to compress at least 90% of the total air supplied to the column system to a base pressure level which is more than 5 bar above the pressure range at which the pressure column is operated, to remove nitrogen-rich gas from the pressure column, and, at least in a first operating mode, to compress further air to a pressure level above the base pressure level, to decompress it, and to warm it without fractionation in the column system, wherein the air fractionation plant is designed to feed, at least in the first operating mode, a portion of the nitrogen-rich gas withdrawn from the pressure column to the further air upstream of the decompression.

14. An air fractionation plant having means for carrying out the method features specified in claim 2.

15. The method according to claim 1, wherein the decompression of the further air is carried out in a decompression turbine.

* * * * *